US008448475B2

(12) United States Patent
Akao et al.

(10) Patent No.: US 8,448,475 B2
(45) Date of Patent: May 28, 2013

(54) SKIN MATERIAL FOR INTERIOR MATERIAL

(75) Inventors: Yuji Akao, Fukui (JP); Fumio Shirasaki, Fukui (JP)

(73) Assignee: Seiren Co., Ltd., Fukui (JP)

( * ) Notice: Subject to any disclaimer, the term of this patent is extended or adjusted under 35 U.S.C. 154(b) by 94 days.

(21) Appl. No.: 13/081,285

(22) Filed: Apr. 6, 2011

(65) Prior Publication Data

US 2011/0247370 A1 Oct. 13, 2011

(30) Foreign Application Priority Data

Apr. 9, 2010 (JP) ..... 2010-090817

(51) Int. Cl.
*D04B 9/06* (2006.01)

(52) U.S. Cl.
USPC ..... 66/193; 66/195

(58) Field of Classification Search
USPC ..... 66/195, 193, 196, 202
See application file for complete search history.

(56) References Cited

U.S. PATENT DOCUMENTS 5,385,036 A * 1/1995 Spillane et al. ..... 66/87
5,732,573 A * 3/1998 Sexton ..... 66/195
5,896,758 A * 4/1999 Rock et al. ..... 66/191
6,105,401 A * 8/2000 Chadeyron et al. ..... 66/195
6,196,032 B1 * 3/2001 Rock et al. ..... 66/195
6,199,410 B1 * 3/2001 Rock et al. ..... 66/195
6,477,865 B1 * 11/2002 Matsumoto ..... 66/195
6,644,070 B2 * 11/2003 Ikenaga et al. ..... 66/196
6,755,052 B1 * 6/2004 Sytz ..... 66/196
6,758,068 B2 * 7/2004 Shirasaki et al. ..... 66/195
7,076,974 B1 * 7/2006 Chen ..... 66/195
7,174,750 B2 * 2/2007 Shirasaki et al. ..... 66/195
7,213,421 B2 * 5/2007 Shirasaki et al. ..... 66/193
7,565,821 B2 * 7/2009 Park et al. ..... 66/195
2003/0106346 A1 * 6/2003 Matsumoto ..... 66/195
2004/0168479 A1 * 9/2004 McMurray ..... 66/202
2011/0247370 A1 * 10/2011 Akao et al. ..... 66/195

FOREIGN PATENT DOCUMENTS

JP 2005-068577 3/2005
JP 2009-262407 11/2009

* cited by examiner

*Primary Examiner* — Danny Worrell
(74) *Attorney, Agent, or Firm* — Jordan and Hamburg LLP

(57) ABSTRACT

The skin material for an interior material, formed of a three-dimensional warp knitted fabric includes: front and back ground parts, each of which is formed with knitting yarns guided by at least two guide bars and has at least two knitting patterns, and connecting yarns that connect the front and back ground parts, wherein: the front ground part has a cord stitch pattern and another knitting pattern; a sum of a number of loops of the cord stitch pattern and a number of loops of the another knitting pattern is smaller than a sum of numbers of loops of the at least two knitting pattern forming the back ground part; and a ratio of the number of loops of the another knitting pattern with respect to the number of loops of the cord stitch pattern is from 20 to 80%.

12 Claims, 3 Drawing Sheets

SKIN MATERIAL FOR INTERIOR MATERIAL

TECHNICAL FIELD

The present invention relates to a skin material for an interior material capable of being used favorably as an interior material of a vehicle, a house and the like.

BACKGROUND ART

A known interior material, such as a ceiling material of a vehicle and an interior wall finishing material of a house, includes ones having a structure containing a base material and a skin material laminated thereon through an adhesive.

For example, a ceiling material of a vehicle, such as a car and a train, contains: a base material formed of a resin molded material, a corrugated fiberboard or the like; a cushioning material formed of foamed polyurethane, nonwoven fabric or the like, which has been laminated between the base material and a skin material by pressing with adhesive interposed between these materials; and the skin material formed of a woven fabric, a knitted fabric or the like. The cushioning material intervening between the base material and the skin material enhances the ornamental appearance and the texture of the ceiling material of a vehicle.

According to the trend of decreasing the environmental load and saving the energy in recent years, however, there is a demand of an interior material having a structure that contains a base material and a skin material laminated directly thereon without a cushioning material, and a skin material suitable for the structure is demanded.

In view of the demand, for example, JP-A-2005-068577 discloses a ceiling material of a vehicle having a base material layer and a skin material layer laminated on each other, in which a cloth having a raised back surface is used as the skin material, and the back surface of the cloth is adhered directly to the base material layer. In particular, there is disclosed that the cloth has a thickness of from 1.0 to 8.0 mm and an air permeability of from 5 to 150 $cm^3/cm^2 \cdot sec$, and has a raised part formed of fibers having a thickness of from 0.5 to 5 dtex and fibers having a thickness of from 3 to 20 dtex, and a tricot knitted fabric shown as one example thereof has a soft touch with cushioning property, is of light weight, is excellent in sound absorbency, and thus is favorably used as a skin material of a ceiling material of a vehicle.

JP-A-2005-068577 discloses a technique using a tricot knitted fabric having a single layer structure as the skin material, which nevertheless causes a problem that oozing out of the adhesive would not be sufficiently prevented from occurring, and thus the ornamental appearance and the touch of the skin material are impaired.

To cope with the problem, for example, JP-A-2009-262407 discloses an interior skin material formed of a three-dimensional knitted fabric that contains a knitted front surface part, a knitted back surface part and a front-back connecting part having connecting yarns that connect the knitted front surface part and the knitted back surface part; the interior skin material is able to be adhered by itself onto a base material without necessity of laminating and adhering an intervening member; and after being adhered onto the base material, excellent ornamental appearance is achieved without appearance failure due to the oozing out of adhesive, and sufficient cushioning property is provided. In particular, it is described that, if an interior skin material has an intermediate load of from 1 to 300 N/inch at a stretch rate of 20% upon measuring in the tensile strength test according to JIS L 1018, the interior skin material is excellent in followability to a base material and thus can be easily molded and adhered to a base material even when the base material has a curved surface, thereby providing an interior skin material having excellent ornamental appearance.

However, JP-A-2009-262407 fails to disclose any specific knitting pattern, of three-dimensional knitted fabric in particular, that provides the skin material of above features. Therefore, it is unclear as to what type of the knitting pattern of the three-dimensional knitted fabric is effective.

SUMMARY OF THE INVENTION

In view of the above, it is aimed to provide a skin material for an interior material, by which, upon laminating the skin material to a base material through an adhesive, oozing out of the adhesive is prevented from occurring, and by which, upon adhering and laminating the skin material to a base material having non-flat surface profile, wrinkle and deformation of the skin material can be prevented from occurring.

A skin material for an interior material according to the invention is a three-dimensional warp knitted fabric that contains: front and back ground parts, each of which is formed by knitting with yarns guided by at least two guide bars and with at least two knitting patterns; and connecting yarns that connect the front and back ground parts; wherein the front ground part is formed of a cord stitch pattern and another knitting pattern that is integrated with the cord stitch pattern; a sum of a number of loops of the cord stitch pattern and a number of loops of the another knitting pattern for the front ground part is smaller than a sum of numbers of loops of the at least two knitting patterns for the back ground part; and a ratio of the number of loops of the another knitting pattern integrated with the cord stitch pattern, with respect to the number of loops of the cord stitch pattern is from 20 to 80%. Resultantly, the front ground part is more stretchable than the back ground part, thereby absorbing the difference in surface area between the front and back ground parts at a time the skin material is laminated onto a base material having a non-flat surface profile.

In the skin material for an interior material, the another knitting pattern integrated with the cord stitch pattern may be knitted by casting off stitches of knitting yarns forming the another knitting pattern, appropriately depending of usage or applications.

The another knitting pattern integrated with the cord stitch pattern may be knitted by making looping of knitting yarns forming the knitting pattern, discontinuous in a warp direction with an interval of a prescribed courses, appropriately depending of usage or applications.

The another knitting pattern integrated with the cord stitch pattern may be knitted by the casting off of the stitches of the knitting yarns and in same time by making looping of the knitting yarns discontinuous in a warp direction appropriately with an interval of a prescribed courses depending of usage or applications.

The another knitting pattern integrated with the cord stitch pattern may be knitted by casting off the stitches with each of the two guide bars, and by making looping of the knitting yarns guided by two guide bars, by an interval of prescribed courses in a warp direction, in an alternate manner with respect to the two guide bars.

In the skin material for an interior material, the back ground part may have two knitting patterns that are formed with knitting yarns guided as full set by two guide bars and integrated with each other, and looping of knitting yarn may be made in all courses without an interval in a warp direction.

In the skin material for an interior material, a spacer layer may be formed with the connecting yarns between the front and back ground parts, and the spacer layer may have a porosity of from 88.0 to 99.8%.

In the skin material for an interior material, among the front and back ground parts, the ground part that is on a side adhered to the base material may have fluff by a raising treatment.

The skin material for an interior material of the invention has such advantages that: upon laminating the skin material to a base material through an adhesive, oozing of the adhesive is prevented from occurring; and upon adhering and laminating the skin material to a base material having a non-flat surface profile, wrinkle and deformation of the skin material can be prevented from occurring because the front ground part is more stretchable than the back ground part, thereby maintaining the good ornamental appearance.

DESCRIPTION OF THE PREFERRED EMBODIMENTS

Figure 1:
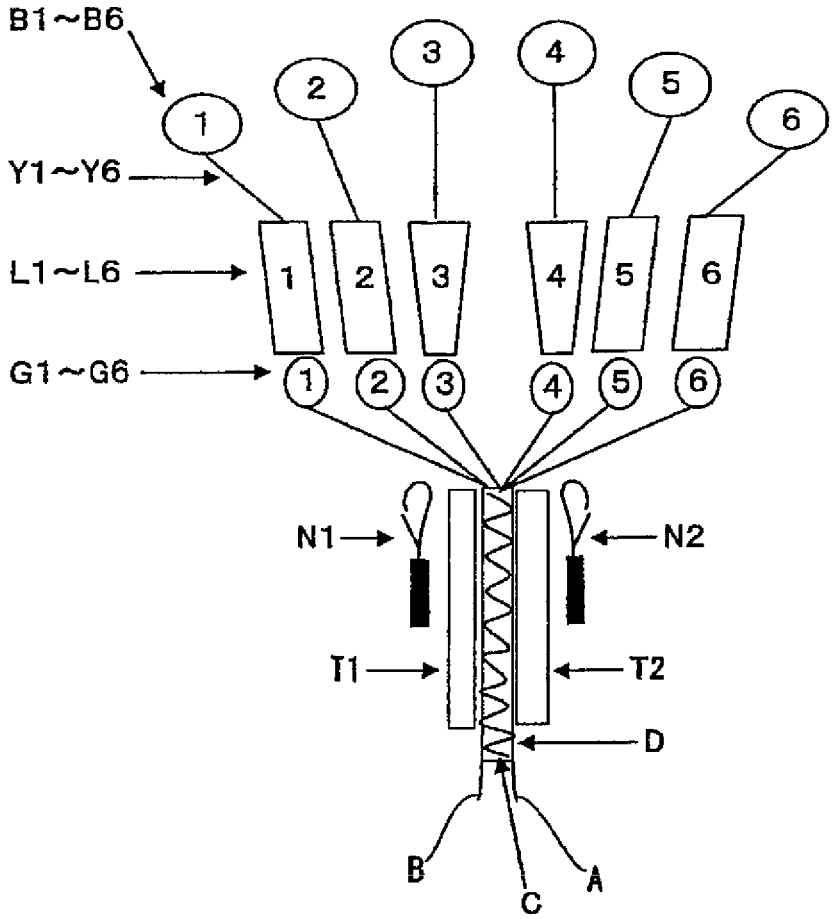
FIG. 1 is a schematic structural diagram showing an essential part of a double raschel knitting machine.

The invention will be described in detail with reference to embodiments below.

The skin material for an interior material (which may be hereinafter referred simply to as a skin material) of the invention contains a three-dimensional warp knitted fabric containing front and back ground parts, i.e., a front ground part and aback ground part, and connecting yarns that connect the front and back ground parts. Each of the front and back ground parts is formed with knitting yarns that are guided by at least two guide bars, and has at least two knitting patterns. The front ground part has a cord stitch pattern and another knitting pattern that is integrated with the cord stitch pattern. The sum of the number of loops of the cord stitch pattern and the number of loops of the another knitting pattern integrated with the cord stitch pattern is smaller than the sum of the numbers of loops of the at least two knitting patterns constituting the back ground part; and the ratio of the number of loops of the another knitting pattern integrated with the cord stitch pattern with respect to the number of loops of the cord stitch pattern is from 20 to 80%.

By use of the three-dimensional warp knitted fabric in the skin material for an interior material, even when an adhesive permeates the ground part on adhered side upon adhering, the adhesive would not ooze out to the ground part on not-adhered side, thereby preventing the touch of the three-dimensional warp knitted fabric from being impaired. Furthermore, the three-dimensional warp knitted fabric may have a spacer layer formed with the connecting yarns between the front and back ground parts, whereby the difference in tension derived from the thickness of the three-dimensional warp knitted fabric laminated on a base material having a non-flat surface profile can be absorbed, and thus wrinkle and deformation of the skin material after adhesion and lamination can be prevented from occurring.

Furthermore, the front ground part of the three-dimensional warp knitted fabric has, as the at least two knitting patterns, a cord stitch pattern and another knitting pattern that is integrated with the cord stitch pattern, in which the sum of the number of loops of the cord stitch pattern and the number of loops of the another knitting pattern integrated with the cord stitch pattern is smaller than the sum of the numbers of loops of the at least two knitting patterns constituting the back ground part; and the ratio of the number of loops of the another knitting pattern integrated with the cord stitch pattern with respect to the number of loops of the cord stitch pattern is from 20 to 80%. Accordingly, the front ground part is more stretchable than the back ground part, and thus the front ground part also absorbs the difference in surface area between the front and back ground parts derived from the thickness of the three-dimensional warp knitted fabric laminated on a base material having a non-flat surface profile. Consequently, wrinkle and deformation of the skin material after adhesion and lamination can be prevented from occurring, in cooperation with the spacer layer of the three-dimensional warp knitted fabric.

The number of loops (which may be referred to as a loop number) per unit area of the knitting patterns in terms of number per $(2.54\ \text{cm})^2$ can be calculated according to the following expression.

$$\text{loop number}=c\times w\times(A/(A+B))\times D/F$$

c: course density of ground part (number per 2.54 cm)
w: wale density of ground part (number per 2.54 cm)
A, B: numerals relating to arrangement of knitting yarn (A in B out)
D: looping number in one wale in repeating unit in warp direction (machine direction)
F: repeating units in warp direction (machine direction) (course number)

The three-dimensional warp knitted fabric can be knitted, for example, by using a double raschel knitting machine having six guide bars L1 to L6 shown in FIG. 1. In FIG. 1, N1 and N2 respectively denote front and back lines of needles, which lines are arranged in parallel in the width direction of the knitting machine; T1 and T2 respectively denote front and back trick plates; Y1 to Y6 denote knitting yarns that are guided through the guide parts G1 to G6 of the guide bars L1 to L6, respectively; and B1 to B6 denote yarn beams of the knitting yarns.

In knitting with the double raschel knitting machine of FIG. 1, the back ground part B is knitted by the needle N1 with the knitting yarns Y1 and Y2 that are as ground yarns guided by at least two guide bars, by the two guide bars L1 and L2 for example; and the front ground part A is knitted by the needle N2 with the knitting yarns Y4, Y5 and Y6 that are as ground yarns guided by at least two guide bars, e.g., three guide bars L4, L5 and L6 as shown in the figure, as ground yarns. The front and back ground parts A and B are connected with the knitting yarns Y3 guided by the guide bar L3 as the connecting yarns C, which are interknitted into the front and back ground parts A and B alternately with the needles N1 and N2. In FIG. 1, D denotes the three-dimensional warp knitted fabric thus knitted.

The front ground part A includes; the cord stitch pattern knitted with ground yarns guided as full set, by guide bar L4 for example; and another knitting pattern knitted with ground yarns guided by guide bars, by the guide bars L5 and L6 for example; and the cord stitch pattern and the another pattern are knitted simultaneously and integrated with each other. At least one of the knitting patterns constituting the front ground part is a cord stitch pattern, whereby the degree of freedom of looping is enhanced to provide a ground part with good stretching property. In particular, number of needles, by which the knitting yarns are underlapped, is preferably from 2 to 5 needles from the standpoint of stretching property. In the case where the number of needles of underlapping exceeds 5 needles, the thickness of the front ground part may be too large to impair the stretching property of the resulting three-dimensional warp knitted fabric in some cases.

The another knitting pattern integrated with the cord stitch pattern is not particularly limited as far as the knitting pattern does not impair the stretching property of the front ground part, and examples thereof include a chain stitch pattern with each knitting yarn basically looped within one wale, and a denbigh stitch pattern with each knitting yarn being looped each time after rightward and leftward transition to the adjacent wale alternately by each course. The another knitting pattern being integrated with the cord stitch pattern is not limited to one or single knitting pattern knitted with one guide bar, and may be constituted by plural knitting patterns, which are knitted with plural guide bars, respectively, and overlapped and combined with each other. Examples of the knitting patterns that may be used in the case where plural knitting patterns are combined include a chain stitch pattern and a denbigh stitch pattern described above, and also include an insert knitting pattern. The positional relationship among the guide bars for knitting the cord stitch pattern and the guide bars for knitting the another knitting pattern integrated with the cord stitch pattern is not limited to the aforementioned positional relationship, and may be changed in consideration of the stretching property, the ornamental appearance, the physical property and the like.

For any knitting pattern used as the another knitting pattern integrated with the cord stitch pattern, the sum of the loop number of the cord stitch pattern and the loop number of the another knitting pattern integrated with the cord stitch pattern (which is the total loop number when plural knitting patterns are combined) is smaller than the sum of the loop numbers of the at least two knitting pattern constituting the back ground part; and in addition, the ratio of the loop number of the another knitting pattern integrated with the cord stitch pattern with respect to the loop number of the cord stitch pattern, which is knitted with full set of yarns arranged and looped in all the courses, is from 20 to 80%, and is preferably from 25 to 70%. In the case of the insert knitting pattern, a part underlapping in the weft direction (width direction) is converted to one loop.

In the case where the sums of the loop numbers of the front ground part and the back ground part have the aforementioned relationship, and the relationship between the loop numbers of the cord stitch pattern and the another knitting pattern integrated with the cord stitch pattern in the front ground part is in the aforementioned range, the front ground part is more stretchable than the back ground part, and thus the difference in surface area between the front and back ground parts derived from the thickness of the three-dimensional warp knitted fabric laminated on a base material having a non-flat surface profile is absorbed, thereby preventing wrinkle and deformation of the skin material after adhesion and lamination from occurring.

In the case where the sum of the loop numbers of the knitting patterns constituting the front ground part is equal to or larger than the sum of the loop numbers of the at least two knitting patterns constituting the back ground part, it is hard to provide the front ground part that is more stretchable than the back ground part. Accordingly, the relationship between the sums of the loop numbers of the front ground part and the back ground part is preferably set as mentioned above.

When the ratio of the loop number of the another knitting pattern integrated with the cord stitch pattern with respect to the loop number of the cord stitch pattern in the front ground part is less than 20%; then, the thickness of the front ground part is decreased, and the strength of the resulting three-dimensional warp knitted fabric is deteriorated. When the ratio exceeds 80%, the difference in the sum of the loop numbers between the front ground part and the back ground part becomes small to fail to provide a difference in stretching property between the front ground part and the background part, and thus the difference in surface area between the front and back ground parts derived from the thickness of the three-dimensional warp knitted fabric laminated on a base material having a non-flat surface profile may not be absorbed, thereby causing wrinkle and deformation of the skin material after adhesion and lamination.

The relationship of the loop numbers in the aforementioned range may be achieved, for example, in such a manner that the knitting yarns for forming the another knitting pattern integrated with the cord stitch pattern are arranged with being cast off appropriately depending on usage or applications, for example, 1-in/1-out or 2-in/1-out; or in such a manner that the another knitting pattern integrated with the cord stitch pattern is knitted by making looping (the machine direction or the knitting direction in warp knitting) of the knitting yarns be discontinuous in the warp direction by an interval of a prescribed courses, appropriately depending on usage or applications, for example, by every one course or two courses, thereby providing looping and non-looping alternately by the interval of prescribed courses; and the aforementioned range may also be achieved by the combination of the arrangement of casting off yarns and the looping with a prescribed course distance, which are mentioned above.

In the case where the another knitting pattern integrated with the cord stitch pattern is knitted with knitting yarns guided by one guide bar; then, the another knitting pattern may be knitted by arranging the knitting yarns appropriately cast off and making looping without an interval or with an interval of prescribed courses; thereby knitting in the warp direction, for example, a chain stitch pattern, a denbigh stitch pattern or a cord stitch pattern. Alternatively, the another knitting pattern may be knitted by guiding the knitting yarns in a full set arrangement or appropriately cast off arrangement to the one guide bar and making looping discontinuous in the warp direction appropriately by an interval of prescribed courses depending on usage or applications. In practice, following is preferred: the cast off arrangement is combined with the making looping by an interval of prescribed courses in the warp direction so that the ratio of the loop number of the another knitting pattern to the loop number of the cord stitch pattern becomes in a range from 20 to 80%. In any one among these arrangements of the another knitting pattern, the knitting pattern may have a part, in which looping is partially omitted in the warp direction and the weft direction.

A following is particularly preferred: the another knitting pattern integrated with the cord stitch pattern is knitted with knitting yarns guided by two or more guide bars; and the knitting yarns of the guide bars are cast off, appropriately depending on usage or applications; and with respect to the two or more guide bars, looping is made alternately in the warp direction by an interval of the prescribed courses; thereby providing the ratio of the loop number of the another knitting pattern integrated with the cord stitch pattern with respect to the loop number of the cord stitch pattern of from 20 to 80%, from the standpoint of providing the front ground part that is more stretchable than the back ground part while maintaining the strength of the front ground part. It is also advantageous for preventing of oozing of an adhesive from occurring upon adhering and laminating the three-dimensional warp knitted fabric to a base material through the adhesive. The number of the guide bars, by which the knitting yarns for knitting the another knitting pattern integrated with the cord stitch pattern are guided, is preferably two from the standpoint of knitting property.

The back ground part B includes at least two knitting patterns formed with knitting yarns guided by at least two guide bars; for example, the back ground part B includes a knitting pattern knitted with a ground yarn guided by the guide bar L1 and a knitting pattern knitted with a ground yarn guided by the guide bar L2, and these two knitting patterns are formed simultaneously and integrated with each other.

The knitting pattern that can be used in the back ground part is not particularly limited, and known knitting patterns, such as a chain stitch pattern, a cord stitch pattern, a denbigh stitch pattern, an atlas stitch pattern and an insert stitch pattern, may be used solely or as a combination of two or more of them. Among these, in a view point that it is possible to properly reduce the stretch in the warp direction with keeping the stretching properties in the back ground part in the case where the gauge of the knitting machine is 22 gauge or less, a combination of a chain stitch pattern and a cord stitch pattern (preferably a cord stitch pattern, in which number of needles of underlapping the knitting yarns is from 2 to 5 needles, and more preferably from 2 to 4 needles) is preferred, and the gauge exceeds 22 gauge, a combination of a denbigh stitch pattern and a denbigh stitch pattern or a combination of a denbigh stitch pattern and a cord stitch pattern (preferably a cord stitch pattern with a number of needles of underlapping of the knitting yarns being from 2 to 5 needles, and more preferably from 2 to 4 needles) is preferred.

Regardless of which among these knitting patterns is adopted, the back ground part is knitted in such a manner that the sum of the loop numbers of the at least two knitting patterns constituting the back ground part is larger than; the sum of the loop number of the cord stitch pattern constituting the front ground part and the loop number of the another knitting pattern integrated with the cord stitch pattern. Accordingly, it is preferred that the at least two knitting patterns constituting the back ground part is knitted with knitting yarns that are guided as full set by at least two guide bars. It is particularly preferred that the back ground part is knitted in such a manner that looping of the knitting yarns are made in all the courses without an interval in the warp direction. For example, in the case where the back ground part is constituted by two knitting patterns, i.e., a chain stitch pattern and a cord stitch pattern, the knitting yarns for forming the knitting patterns are arranged as full set and looping is made in all the courses. Resultantly, the sum of the loop numbers of the knitting patterns constituting the back ground part becomes larger than the sum of the loop numbers of the knitting patterns constituting the front ground part, thereby making the front ground part more stretchable than the back ground part.

With respect to the circular moduli of the three-dimensional warp knitted fabric constituting the skin material, the 10% circular modulus is preferably from 10 to 100 N in the warp direction, from 5 to 50 N in the weft direction, from 9 to 150 N in the bias direction, and from 10 to 160 N in the reverse bias direction; the 20% circular modulus is preferably from 30 to 290 N in the warp direction, from 15 to 100 N in the weft direction, from 25 to 100 N in the bias direction, and from 30 to 100 N in the reverse bias direction; and the 30% circular modulus is preferably from 90 to 550 N in the warp direction, from 25 to 200 N in the weft direction, from 65 to 300 N in the bias direction, and from 70 to 250 N in the reverse bias direction. More preferably, the 10% circular modulus is from 10 to 70 N in the warp direction, from 10 to 30 N in the weft direction, from 10 to 100 N in the bias direction, and from 10 to 100 N in the reverse bias direction; the 20% circular modulus is more preferably from 30 to 270 N in the warp direction, from 30 to 85 N in the weft direction, from 30 to 100 N in the bias direction, and from 30 to 80 N in the reverse bias direction; and the 30% circular modulus is more preferably from 90 to 460 N in the warp direction, from 50 to 200 N in the weft direction, from 90 to 300 N in the bias direction, and from 100 to 250 N in the reverse bias direction.

When the circular moduli of the three-dimensional warp knitted fabric are in the aforementioned ranges, upon laminating the skin material to a base material having a non-flat surface profile, the skin material is able to follow the non-flat surface profile, thereby preventing wrinkle and deformation of the skin material after adhesion and lamination from occurring. When the circular moduli of the three-dimensional warp knitted fabric are less than the lower limits, the skin material may fail to follow the non-flat surface profile, and the skin material may suffer wrinkle and deformation after adhesion and lamination. When the circular moduli of the three-dimensional warp knitted fabric exceed the upper limits, the skin material may suffer deformation dents after adhesion and lamination. The skin material of the invention may have the circular moduli in the aforementioned ranges owing to the aforementioned features in knitting, thereby achieving the advantages.

The stretch rate of the front ground part is larger than the stretch rate of the back ground part. By this feature, the difference in tension derived from the thickness of the three-dimensional warp knitted fabric laminated on a base material having a non-flat surface profile would be absorbed, and thus wrinkle and deformation of the skin material after adhesion and lamination would be prevented from occurring. The stretch rate of the front ground part becomes larger than the stretch rate of the back ground part by such a manner that the front and back ground parts each are formed with knitting yarns guided by at least two guide bars and each have at least two knitting patterns, the front ground part has a cord stitch pattern and another knitting pattern that is integrated with the cord stitch pattern, the sum of the loop number of the cord stitch pattern and the loop number of the another knitting pattern integrated with the cord stitch pattern is smaller than the sum of the loop numbers of the at least two knitting pattern constituting the back ground part, and the ratio of the loop number of the another knitting pattern integrated with the cord stitch pattern with respect to the loop number of the cord stitch pattern is from 20 to 80%.

The terms, the front ground part and the back ground part, are properly used expediently, and a surface of any one of the ground parts may be laminated on a base material. For example, in the case of a base material having a non-flat surface profile where convex part(s) is predominant, the skin material is preferably adhered and laminated with the side of the back ground part in contact with the base material; and in the case of a base material having a non-flat surface profile where concave part(s) is predominant, the skin material is preferably adhered and laminated with the side of the front ground part in contact with the base material. By this way, the difference in surface area between the front and back ground parts derived from the thickness of the three-dimensional warp knitted fabric upon lamination on a base material having a non-flat surface profile is absorbed, thereby preventing wrinkle and deformation of the skin material after adhesion and lamination from occurring.

A spacer layer may be formed with the connecting yarns between the front and back ground parts of the three-dimensional warp knitted fabric. The spacer layer preferably has a porosity of from 88.0 to 99.8%, and more preferably from 95.0 to 99.7%. When the porosity is in such range, oozing of an adhesive is prevented from occurring at the connected part, thereby providing good touch. Furthermore, the deformation of the ground part derived from the tension applied to the three-dimensional warp knitted fabric upon lamination on a base material having a non-flat surface profile, particularly the deformation of the ground part that is adhered to the base material, is prevented from being propagated to the other ground part (i.e., the ground part that is not adhered to the base material), thereby preventing wrinkle and deformation of the skin material after adhesion and lamination from occurring. When the porosity is less than 88.0%, the three-dimensional warp knitted fabric may be difficult to maintain the thickness thereof, and wrinkle and deformation of the skin material may occur after adhesion and lamination on a base material having a non-flat surface profile. When the porosity exceeds 99.8%, the stretch property of the three-dimensional warp knitted fabric may be impaired, the deformation of the ground part that is adhered to the base material may be liable to be propagated to the other ground part (i.e., the ground part that is not adhered to the base material), and wrinkle and deformation of the skin material may occur after adhesion and lamination.

The porosity can be calculated according to the following expression.

$$\text{porosity}(\%)=100-(2\times c\times w\times D)/(2.54^2\times 10^6\times\rho))\times 100$$

c: course density of ground part (number per 2.54 cm)
w: wale density of ground part (number per 2.54 cm)
D: fineness of connecting yarn (dtex)
ρ: specific gravity of connecting yarn (g/cm$^3$)

Polyester (which is a fiber material that may be preferably used in the invention) has a specific gravity of 1.38 g/cm$^3$.

The porosity has the following relationship to a filling factor.

$$\text{porosity}(\%)=100-\text{filling factor}$$

The filling factor can be calculated according to the following expression.

$$\text{filling factor}(\%)=(((\text{cross sectional area of connecting yarns})\times(\text{number of connecting yarns}))/(\text{unit area}))\times 100=(\pi r^2\times(c\times w\times 2)/2.54^2)\times 100$$

r: radius (cm) of connecting yarn assuming that connecting yarn is monofilament with circular cross section
c: course density of ground part, i.e., number of loops in warp direction (machine direction) per 1 inch (2.54 cm)
w: wale density of ground part, i.e., number of loops in weft direction (width direction) per 1 inch (2.54 cm)
2: number of connecting yarns connected on the looping on the ground part per one looping thereon The unit "dtex" for the fineness of the yarn means the weight (in terms of gram) of the yarn per a length of 10,000 m (1,000,000 cm). Accordingly, the following relationship is established with the fineness D of the yarn (connecting yarn).

$$D(g)=\pi r^2\times 10^6\times\rho$$

ρ: specific gravity of yarn (g/cm$^3$)

Thus, the following relationship is established.

$$\pi r^2=D/(10^6\times\rho)$$

When the relationship is applied to the expression of the porosity, the porosity is consequently obtained by the following expression.

$$\text{porosity}(\%)=((2\times c\times w\times D)/(2.54^2\times 10^6\times\rho))\times 100$$

Manner of connecting the connecting yarns to the front and back ground parts may be either one of following (1) to (3): (1) the connecting yarns are stitched in the orthogonal direction with respect to the front and back ground parts; (2) the connecting yarns are stitched in the diagonal direction with respect to the front and back ground parts; and (3) the mixed manner of (1) and (2); and it is preferred that the connecting yarns are stitched in the diagonal direction with respect to the front and back ground parts with number of needles of underlapping being from 1 to 3 needles in the weft direction in view of preventing oozing of the adhesive from occurring and/or in view of keeping the thickness of the three-dimensional warp knitted fabric.

The gauge of the knitting machine for knitting the three-dimensional warp knitted fabric is not particularly limited and may be appropriately selected depending on usage or applications, and the gauge is preferably from 14 to 32 gauge, and more preferably from 22 to 28 gauge. When the gauge is less than 14 gauge, the three-dimensional warp knitted fabric may be poor in shape retaining property, and sufficient physical properties may not be obtained. When the gauge exceeds 32 gauge, the knitting operation may be difficult to perform, and the three-dimensional warp knitted fabric may be deteriorated in texture and touch.

The course density after finishing is preferably from 20 to 60 per 2.54 cm, and more preferably from 24 to 50 per 2.54 cm. The wale density is preferably from 16 to 40 per 2.54 cm, and more preferably from 18 to 36 per 2.54 cm. When the densities are less than the lower limits, the skin material may suffer deformation dents or oozing of the adhesive after adhesion and lamination. When the densities exceed the upper limits, the stretch property of the three-dimensional warp knitted fabric may be impaired, whereby the skin material may suffer wrinkle after adhesion and lamination, and the three-dimensional warp knitted fabric may be deteriorated in texture and touch.

The fiber material of the yarns (knitting yarns) used as the ground yarns for knitting the front and back ground parts and the connecting yarns is not particularly limited, and may be appropriately selected depending on usage or applications from known fibers, such as natural fibers, regenerated fibers, semi-synthetic fibers and synthetic fibers, and synthetic fibers are preferred owing to the excellent physical properties thereof, with polyester being particularly preferred.

The form of the yarn is not particularly limited, and may be selected in a proper manner depending on usage or applications from known yarn forms, such as a spun yarn, a multifilament yarn and a monofilament yarn. Among these, the yarns used as the connecting yarns are preferably multifilament yarns, particularly the multifilament yarns imparted with crimp property (which may be referred simply to as multifilament textured yarns or as a textured yarns) because the difference in the tension derived from the thickness of the three-dimensional warp knitted fabric upon lamination on a base material having a non-flat surface profile would be absorbed.

The fineness of the yarns used as the ground yarns for knitting the front and back ground parts is not particularly limited, and is preferably from 33 to 440 dtex. When the fineness is less than 33 dtex, the three-dimensional warp knitted fabric may not satisfy the demanded physical properties. When the fineness exceeds 440 dtex, the three-dimensional warp knitted fabric may be impaired in stretch property to cause wrinkles and deformation in the skin material after adhesion and lamination, and the three-dimensional warp knitted fabric may be deteriorated in texture and touch.

The single filament fineness thereof is also not particularly limited, and is preferably from 0.5 to 3 dtex. When the single filament fineness is less than 0.5 dtex, the three-dimensional warp knitted fabric may not satisfy the demanded physical properties. When the single filament fineness exceeds 3 dtex, the three-dimensional warp knitted fabric may be deteriorated in texture and touch, and may also be deteriorated in raising property when it is raised.

The fineness of the yarn used as the connecting yarns is preferably from 33 to 440 dtex, and more preferably from 33 to 330 dtex. When the fineness is less than 33 dtex, the thickness of the three-dimensional warp knitted fabric may not be retained, and the skin material may suffer wrinkles and deformation upon lamination on a base material having a non-flat surface profile. When the fineness exceeds 440 dtex, the three-dimensional warp knitted fabric may be deteriorated in stretch property, and the deformation of the ground part that is adhered to the base material may be propagated to the other ground part (i.e., the ground part that is not adhered to the base material), thereby causing wrinkle and deformation of the skin material after adhesion and lamination.

The single filament fineness thereof is preferably from 0.9 to 11 dtex, and more preferably from 2.3 to 5.5 dtex. When the single filament fineness is less than 0.9 dtex, the thickness of the three-dimensional warp knitted fabric may not be retained, and the skin material may suffer wrinkles and deformation upon lamination on a base material having a non-flat surface profile, and may suffer oozing out of the adhesive. When the single filament fineness exceeds 11 dtex, the three-dimensional warp knitted fabric may be deteriorated in stretch property to cause wrinkles and deformation in the skin material after adhesion and lamination, and the three-dimensional warp knitted fabric may be deteriorated in texture and touch.

The thickness of the three-dimensional warp knitted fabric is preferably from 1.5 to 5.0 mm, and more preferably from 1.8 to 4.0 mm. When the thickness is less than 1.5 mm, the skin material may suffer deformation dents or the adhesive exuding after adhesion and lamination. When the thickness exceeds 5.0 mm, the three-dimensional warp knitted fabric may be deteriorated in stretch property to cause wrinkles in the skin material after adhesion and lamination, and the three-dimensional warp knitted fabric may be deteriorated in texture and touch.

In the three-dimensional warp knitted fabric, the ground part that is on the side adhered to the base material among the front and back ground parts preferably has fluff by a raising treatment. Accordingly, oozing of the adhesive would be effectively prevented from occurring; thereby allowing of increasing the coated amount thereof without deterioration of the texture, touch and ornamental appearance; and thus the adhesion strength would be enhanced. Examples of the method of raising the ground part include a card clothing raising treatment with a card clothing and an emery raising treatment with sandpaper. In the card clothing raising treatment, the state of raising would be appropriately controlled by selecting the conditions, such as the density, length, angle and shape of point of the card clothing, the rotation number of the card clothing upon raising, and the contact pressure and the contact times thereof to the three-dimensional warp knitted fabric. After raising, a shearing treatment for trimming the fluff may be performed if necessary.

Consequently, the three-dimensional warp knitted fabric constituting the skin material is provided.

The method of laminating the skin material of the invention and a base material through an adhesive is not particularly limited, and may be appropriately selected from known methods. Examples of the method include: pressing with a film or powder of a hot-melt resin at a temperature higher than the melting point of the hot-melt resin; and pressing with a solvent-based or aqueous adhesive. Upon using a powder or liquid adhesive, the adhesive may be applied to the three-dimensional warp knitted fabric or the base material.

The laminated article thus obtained has good touch without wrinkles or deformation on the surface of the skin material.

EXAMPLE

The invention will be described in more detail with reference to examples below, but the invention is not limited to the examples. The evaluation tests in the examples were performed in the following manners.

Circular Modulus

Three test pieces having a diameter of 300 mm were each collected in the four directions, i.e., the warp direction, the weft direction, the bias direction and the reverse bias direction, from the three-dimensional warp knitted fabric.

The test piece was attached to a low-speed tensile tester (Autograph AG-1, available from Shimadzu Corporation) with a chuck distance of 200 mm. The sizes of the chucks were 25.4 mm in length×25.4 mm in width on the front side and 25.4 mm in length×50.8 mm in width on the back side for both the upper and lower chucks. The initial load was 0.98 N.

The test piece was pulled at a tensile rate of 200 mm/min to a stretch rate of 30%, thereby obtained is a load-stretch curve.

The loads (N per 25.4 mm) on stretch rates of 10%, 20% and 30% were read from the load-stretch curve. In the case where the test piece was broken until the stretch rate reached 30%, the loads on stretch rates before breakage were read.

Average values of the three test pieces for the read values on stretch rates of 10%, 20% and 30% in each of the directions were designated as values of the circular modulus.

Wrinkles

The surface of the skin material after adhesion and lamination on a base material was visually evaluated, and determined by the following standard.

A: substantially no wrinkle found
B: slight wrinkles found
C: noticeable wrinkles found Deformation The surface of the skin material after adhesion and lamination on a base material was visually evaluated, and determined by the following standard.

A: substantially no deformation found
B: slight deformation found
C: noticeable deformation found Touch The surface of the skin material after adhesion and lamination on a base material was evaluated sensorily, and determined by the following standard.

A: soft touch
B: partially hard touch
C: totally hard touch

Example 1

Figure 2:
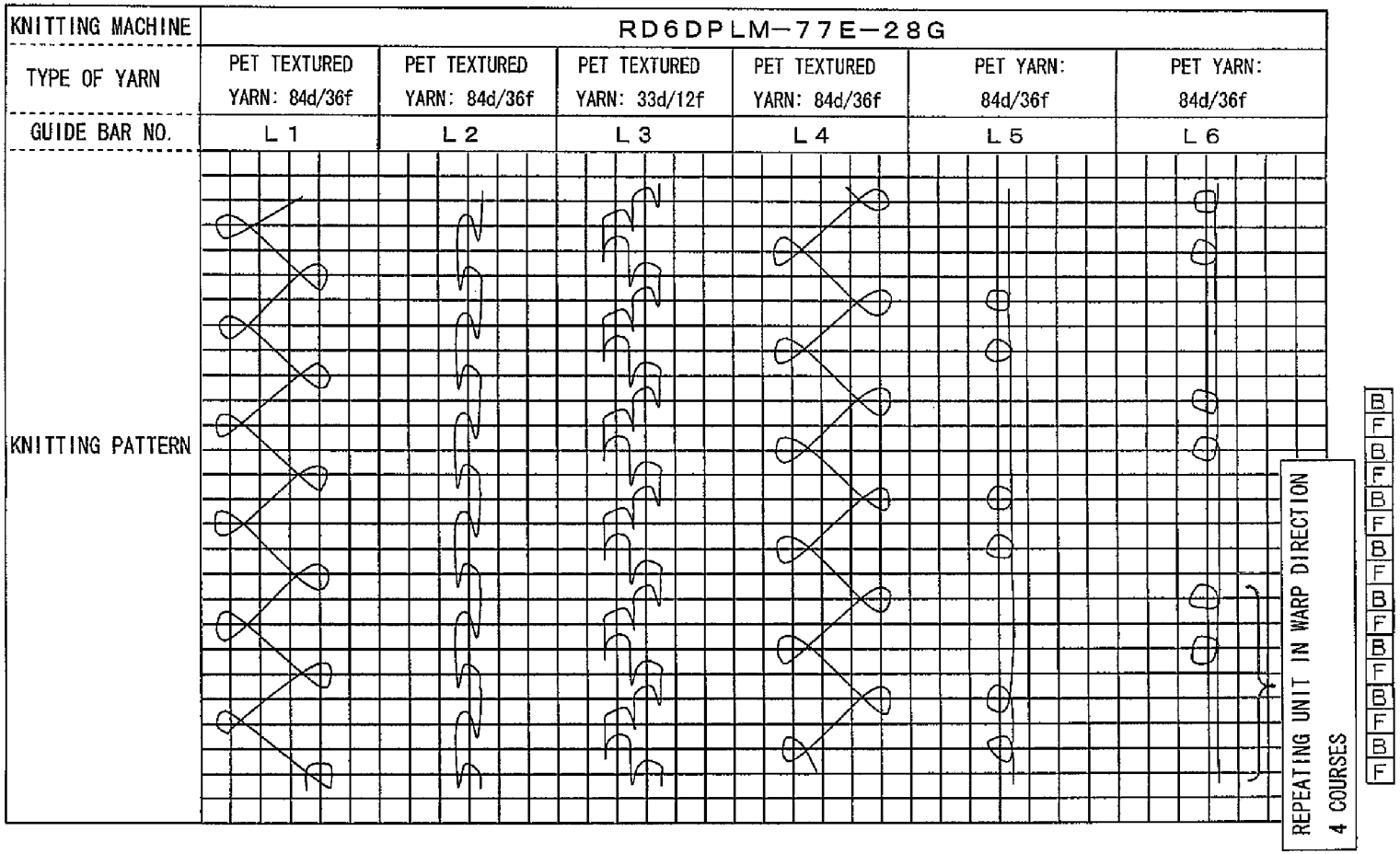
FIG. 2 is a structural diagram showing a three-dimensional warp knitted fabric forming a skin material for an interior material in Example 1.

A three-dimensional warp knitted fabric was knitted by using a double raschel knitting machine (RD 6 DPLM-77E-22G, available from Karl Mayer Corporation) in such a manner as shown in FIG. 2 and Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a chain stitch pattern knitted with ground yarns (84 dtex/36 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (84 dtex/36 filaments polyester multifilament textured yarns) guided as full set by the guide bar L4 with number of needles of underlapping of the ground yarns being three needles; and a knitting pattern knitted with ground yarns (both 84 dtex/36 filaments polyester multifilament yarns) guided as 3-in/1-out (i.e., an arrangement of three yarns with one for cast off) by each of the guide bars L5 and L6, in which looping of the ground yarns guided by the guide bars L5 and L6 was made alternately in one wale, for two courses by every two courses (looping number per one repeating unit: 2 courses, repeating unit: 4 courses); where fabric parts of the cord stitch pattern and the latter knitting pattern were integrated with each other.

The connecting yarns (33 dtex/12 filaments polyester multifilament textured yarns) connecting the front and back ground parts were guided as full set by the guide bar L3.

The three-dimensional warp knitted fabric was subjected to heat treatment (pre-setting) at 190° C. for 1 minute and then dyed with a jet dyeing machine at 130° C. for 30 minutes. The three-dimensional warp knitted fabric was dried at 150° C.; the ground yarns constituting the front ground part were raised with a card clothing raising machine; and then the three-dimensional warp knitted fabric was subjected to heat treatment (finishing up setting) at 190° C. for 1 minute, thereby providing a skin material according to the invention.

A polyethylene film of 80 g/m$^2$ was laminated on the side of the front ground part of the resulting skin material and heat-treated at 200° C. for 1 minute, and immediately the assembly was inverted and placed on a base material having a non-flat surface profile formed of a foamed resin molded article, thereby providing a laminated article.

The resulting laminated article was evaluated for wrinkles, deformation and touch. The results of evaluation are shown in Table 2.

Example 2

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4, L5 and L6; and the front and back ground parts were connected with; connecting yarns guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a denbigh stitch pattern knitted with ground yarns (84 dtex/36 filaments polyester multifilament textured yarns) guided as full set by the guide bar L2; where the fabric parts of the cord stitch pattern and the denbigh stitch pattern were integrated with each other.

The front ground part was formed of: a cord stitch pattern knitted with ground yarns (84 dtex/36 filaments polyester multifilament textured yarns) guided as full set by the guide bar L4 with number of needles of underlapping of the ground yarns being two needles; and a knitting pattern knitted with ground yarns (both 84 dtex/36 filaments polyester multifilament yarns) guided as 2-in/2-out (i.e., an arrangement of two yarns with two for cast off) by each of the guide bars L5 and L6, in which looping of the ground yarns guided by the guide bars L5 and L6 was made alternately in one wale, for two courses by every two courses (looping number per one repeating unit: 2 courses, repeating unit: 4 courses); where fabric parts of the cord stitch pattern and the latter knitting pattern were integrated with each other.

The connecting yarns (110 dtex/48 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Example 3

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a cord stitch pattern knitted with ground yarns (110 dtex/48 filaments polyester multifilament textured yarns) guided as full set by the guide bar L1 with number of needles of underlapping of the ground yarns being three needles; and a chain stitch pattern knitted with ground yarns (110 dtex/48 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (110 dtex/48 filaments polyester multifilament textured yarns) guided as full set by the guide bar L4 with number of needles of underlapping of the ground yarns being two needles; and a knitting pattern knitted with ground yarns (both 110 dtex/48 filaments polyester multifilament yarns) guided as 1-in/3-out (i.e., an arrangement of one yarn with three for cast off) by each of the guide bars L5 and L6, in which looping of the ground yarns guided by the guide bars L5 and L6 was made alternately in one wale, for three courses by every three courses (looping number per one repeating unit: 3 courses, repeating unit: 6 courses); where fabric parts of the cord stitch pattern and the latter knitting pattern were integrated with each other.

The connecting yarns (167 dtex/48 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Example 4

A three-dimensional warp knitted fabric was knitted by using a double raschel knitting machine (RD 6 DPLM-77E-18G, available from Karl Mayer Corporation) in such a manner as shown in Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a cord stitch pattern knitted with ground yarns (167 dtex/48 filaments polyester multifilament textured yarns) guided as full set by the guide bar L1 with number of needles of underlapping of the ground yarns being three needles; and a chain stitch pattern knitted with ground yarns (167 dtex/48 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (167 dtex/48 filaments polyester multifilament textured yarns) guided as full set by the guide bar L4 with number of needles of underlapping of the ground yarns being two needles; and a knitting pattern knitted with ground yarns (both 167 dtex/48 filaments polyester multifilament yarns) guided as 1-in/1-out (i.e., an arrangement of one yarn with one for cast off) by each of the guide bars L5 and L6, in which looping of the ground yarns guided by the guide bars L5 and L6 were made alternately in one wale, for three courses by every three courses (looping number per one repeating unit: 3 courses, repeating unit: 6 courses); where fabric parts of the cord stitch pattern and the latter knitting pattern were integrated with each other.

The connecting yarns (440 dtex/96 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Example 5

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a chain stitch pattern knitted with ground yarns (84 dtex/36 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (84 dtex/36 filaments polyester multifilament textured yarns) guided as full set by the guide bar L4 with number of needles of underlapping of the ground yarns being two needles; and a knitting pattern knitted with ground yarns (both 84 dtex/36 filaments polyester multifilament yarns) guided as 1-in/1-out (i.e., an arrangement of one yarn with one for cast off) by each of the guide bars L5 and L6, in which looping of the ground yarns guided by the guide bars L5 and L6 was made alternately in one wale, for two courses by every two courses (looping number per one repeating unit: 2 courses, repeating unit: 4 courses); where fabric parts of the cord stitch pattern and the latter knitting pattern were integrated with each other.

The connecting yarns (84 dtex/36 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Example 6

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4 and L5; and the front and back ground parts were connected with a connecting yarn guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a chain stitch pattern knitted with ground yarns (84 dtex/36 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (167 dtex/48 filaments polyester multifilament textured yarns) guided as full set by the guide bar L4 with number of needles of underlapping of the ground yarns being three needles; and a denbigh stitch pattern knitted with ground yarns (84 dtex/36 filaments polyester multifilament yarns) guided as 2-in/2-out (i.e., an arrangement of two yarns with two for cast off) by the guide bar L5; where fabric parts of the cord stitch pattern and the denbigh stitch pattern were integrated with each other.

The connecting yarns (84 dtex/36 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Example 7

A three-dimensional warp knitted fabric was knitted by using a double raschel knitting machine (RD 6 DPLM-77E-28G, available from Karl Mayer Corporation) in such a manner as shown in Table 1 that: a back ground part was knitted with ground yarns guided by the guide bars L1 and L2; a front ground part was knitted with ground yarns guided by the guide bars L4 and L5; and the front and back ground parts were connected with connecting yarns guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a chain stitch pattern knitted with ground yarns (84 dtex/36 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (167 dtex/48 filaments polyester multifilament textured yarns) guided as full set by the guide bar L4 with number of needles of underlapping of the ground yarns being two needles; and a knitting pattern knitted by ground yarns (84 dtex/36 filaments polyester multifilament yarns) guided as full set by the guide bar L5 for two courses by every two courses (looping number per one repeating unit: 2 courses, repeating unit: 4 courses); where fabric parts of the cord stitch pattern and the latter knitting pattern were integrated with each other.

The connecting yarns (84 dtex/36 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Example 8

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a chain stitch pattern knitted with ground yarns (84 dtex/36 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (84 dtex/36 filaments polyester multifilament textured yarns) guided as full set by the guide bar L4 with number of needles of underlapping of the ground yarns being two needles; and a knitting pattern knitted with each pair of ground yarns (both 84 dtex/36 filaments polyester multifilament yarns) being alternately guided as 2-in/2-out (i.e., an arrangement of two yarns with two for cast off) by each of the guide bars L5 and L6, in which looping of the ground yarns guided by the guide bars L5 and L6 was made alternately in adjacent wale, for two courses by every two courses (looping number per one repeating unit: 2 courses, repeating unit: 4 courses); where fabric parts of the cord stitch pattern and the latter knitting pattern were integrated with each other.

The connecting yarns (84 dtex/36 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Example 9

Figure 3:
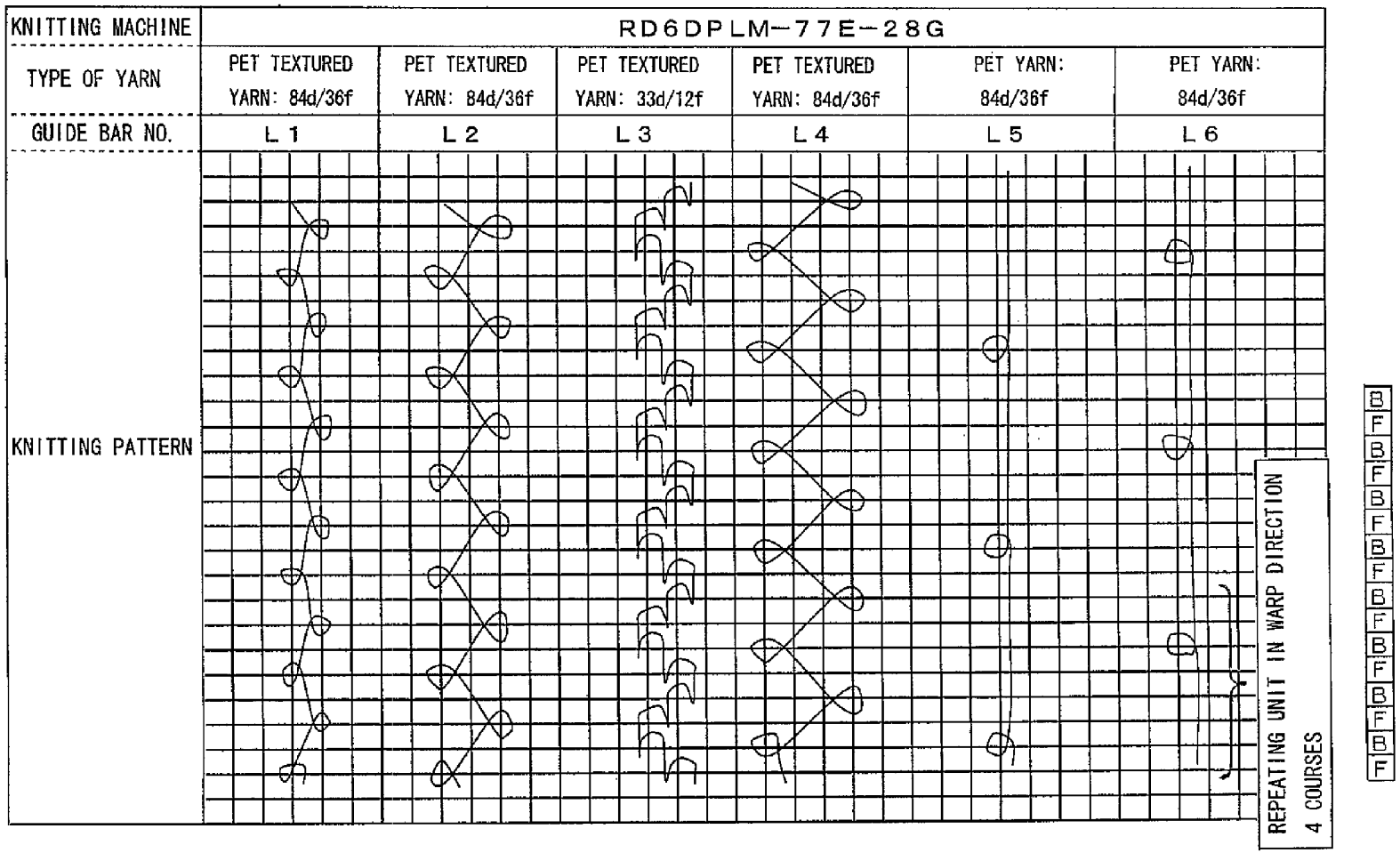
FIG. 3 is a structural diagram showing a three-dimensional warp knitted fabric forming a skin material for an interior material in Example 9.

A three-dimensional warp knitted fabric was knitted by using a double raschel knitting machine (RD 6 DPLM-77E-28G, available from Karl Mayer Corporation) in such a manner as shown in FIG. 3 and Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a denbigh stitch pattern knitted with ground yarns (84 dtex/36 filaments polyester multifilament textured yarns) guided as full set by the guide bar L1; and a cord stitch pattern knitted with ground yarns (84 dtex/36 filaments polyester multifilament textured yarns) guided as full set by the guide bar L2 with number of needles of underlapping of the ground yarns being two needles; where fabric parts of the denbigh stitch pattern and the cord stitch pattern were integrated with each other.

The front ground part was formed of: a cord stitch pattern knitted with ground yarns (84 dtex/36 filaments polyester multifilament textured yarns) guided as full set by the guide bar L4 with number of needles of underlapping of the ground yarns being three needles; and a knitting pattern knitted with ground yarns (both 84 dtex/36 filaments polyester multifilament yarns) guided as 2-in/2-out (i.e., an arrangement of two yarns with two for cast off) by each of the guide bars L5 and L6, in which looping of the ground yarns guided by the guide bars L5 and L6 was made alternately in one wale, for one course by every three courses (looping number per one repeating unit: 1 course, repeating unit: 4 courses); where fabric parts of the cord stitch pattern and the latter knitting pattern were integrated with each other.

The connecting yarn (33 dtex/12 filaments polyester multifilament textured yarns) connecting the front and back ground parts were guided as full set by the guide bar L3.

Thereafter, a skin material according to the invention and a laminated article were obtained in the same manner as in Example 1. The results of evaluation of the laminated article are shown in Table 2.

Comparative Example 1

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a chain stitch pattern knitted with ground yarns (84 dtex/36 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (84 dtex/36 filaments polyester multifilament textured yarns) guided as full set by the guide bar L4 with number of needles of underlapping of the ground yarns being two needles; and a knitting pattern knitted with ground yarns (both 84 dtex/36 filaments polyester multifilament yarns) guided as full set by each of the guide bars L5 and L6, in which looping of the ground yarns guided by the guide bars L5 and L6 was made alternately in one wale, for two courses by every two courses (looping number per one repeating unit: 2 courses, repeating unit: 4 courses); where fabric parts of the cord stitch pattern and the latter knitting pattern were integrated with each other.

The connecting yarns (33 dtex/12 filaments polyester multifilament textured yarns) connecting the front and back ground parts were guided as full set by the guide bar L3.

Thereafter, a skin material and a laminated article were obtained in the same manner as in Example 1. The results of evaluation of the laminated article are shown in Table 2.

Comparative Example 2

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4 and L5; and the front and back ground parts were connected with connecting yarns guided by the guide bar L3.

The back ground part was formed of: a cord stitch pattern knitted with ground yarns (84 dtex/36 filaments polyester multifilament textured yarns) guided as full set by the guide bar L1 with number of needles of underlapping of the ground yarns being three needles; and a chain stitch pattern knitted with ground yarns (84 dtex/36 filaments polyester multifilament textured yarns) guided as full set by the guide bar L2; where fabric parts of the cord stitch pattern and the chain stitch pattern were integrated with each other.

The front ground part was formed of: a cord stitch pattern knitted with ground yarns (84 dtex/36 filaments polyester multifilament textured yarns) guided as full set by the guide bar L4 with number of needles of underlapping of the ground yarns being three needles; and a knitting pattern knitted with ground yarns (84 dtex/36 filaments polyester multifilament yarns) guided as 1-in/1-out (i.e., an arrangement of one yarn with one for cast off) by the guide bar L5 for one course by every three courses (looping number per one repeating unit: 1 course, repeating unit: 4 courses); where fabric parts of the cord stitch pattern and the latter knitting pattern were integrated with each other.

The connecting yarns (220 dtex/96 filaments polyester multifilament textured yarns) connecting the front and back ground parts were guided as full set by the guide bar L3.

Thereafter, a skin material and a laminated article were obtained in the same manner as in Example 1. The results of evaluation of the laminated article are shown in Table 2.

Comparative Example 3

A three-dimensional warp knitted fabric was knitted by using a double raschel knitting machine (RD 6 DPLM-77E-22G, available from Karl Mayer Corporation) in such a manner as shown in Table 1 that: a back ground part was knitted with ground yarns guided by the guide bars L1 and L2; a front ground part was knitted with ground yarns guided by the guide bars L4, L5 and L6; and the front and back ground parts were connected with connecting yarns guided by the guide bar L3.

The back ground part was formed of: a cord stitch pattern knitted with ground yarns (110 dtex/48 filaments polyester multifilament textured yarns) guided as full set by the guide bar L1 with number of needles of underlapping of the ground yarns being three needles; and a denbigh stitch pattern knitted with ground yarns (110 dtex/48 filaments polyester multifilament textured yarns) guided as full set by the guide bar L2; where fabric parts of the cord stitch pattern and the denbigh stitch pattern were integrated with each other.

The front ground part was formed of: a denbigh stitch pattern knitted with ground yarns (110 dtex/48 filaments polyester multifilament textured yarns) guided as full set by the guide bar L4; and a knitting pattern knitted with ground yarns (both 110 dtex/48 filaments polyester multifilament yarns) guided as 1-in/1-out (i.e., an arrangement of one yarn with one for cast off) by each of the guide bars L5 and L6, in which looping of the ground yarns guided by the guide bars L5 and L6 was made alternately in one wale, for two courses by every two courses (looping number per one repeating unit: 2 courses, repeating unit: 4 courses); where fabric parts of the denbigh stitch pattern and the latter knitting pattern were integrated with each other.

The connecting yarns (330 dtex/96 filaments polyester multifilament textured yarns) connecting the front and back ground parts were guided as full set by the guide bar L3.

Thereafter, a skin material and a laminated article were obtained in the same manner as in Example 1. The results of evaluation of the laminated article are shown in Table 2.

TABLE 1

| | | | Example 1 | Example 2 | Example 3 | Example 4 | Example 5 | Example 6 |
|---|---|---|---|---|---|---|---|---|
| Gauge of knitting machine | | | 22 G | 22 G | 22 G | 18 G | 22 G | 22 G |
| Back ground part | L1 | Knitting pattern | cord (3 needles) | cord (3 needles) | cord (3 needles) | cord (3 needles) | cord (3 needles) | cord (3 needles) |
| | | Yarn | 84d/36f | 84d/36f | 110d/48f | 167d/48f | 84d/36f | 84d/36f |
| | | Loop number (per (25.4 mm)$^2$) | 816 | 960 | 1,250 | 480 | 816 | 768 |
| | L2 | Knitting pattern | chain | denbigh | chain | chain | chain | chain |
| | | Yarn | 84d/36f | 84d/36f | 110d/48f | 167d/48f | 84d/36f | 84d/36f |
| | | Loop number (per (25.4 mm)$^2$) | 816 | 960 | 1,250 | 480 | 816 | 768 |
| | Sum of loop numbers of L1 and L2 (per (25.4 mm)$^2$) | | 1,632 | 1,920 | 2,500 | 960 | 1,632 | 1,536 |
| Connecting yarn | L3 | Yarn | 33d/12f | 110d/48f | 167d/48f | 440d/96f | 84c136f | 84d/36f |
| Front ground part | L4 | Knitting pattern | cord (3 needles) | cord (2 needles) | cord (2 needles) | cord (2 needles) | cord (2 needles) | cord (3 needles) |
| | | Yarn | 84d/36f | 84d/36f | 110d/48f | 167d/48f | 84d/36f | 167d/48f |
| | | Loop number (per (25.4 mm)$^2$) | 816 | 960 | 1,250 | 480 | 816 | 768 |
| | L5 | Knitting pattern or loop number/repeating unit | 2c/4c | 2c/4c | 3c/6c | 3c/6c | 2c/4c | denbigh |
| | | Yarn | 84d/36f | 84d/36f | 110d/48f | 167d/48f | 84d/36f | 84d/36f |
| | | Arrangement | 3-in/1-out | 2-in/2-out | 1-in/3-out | 1-in/1-out | 1-in/1-out | 2-in/2-out |
| | | Loop number (per (25.4 mm)$^2$) | 306 | 240 | 156.25 | 120 | 204 | 384 |

TABLE 1-continued

| | | | | | | | |
|---|---|---|---|---|---|---|---|
| | L6 | Loop number/repeating unit | 2c/4c | 2c/4c | 3c/6c | 3c/6c | 2c/4c | — |
| | | Yarn | 84d/36f | 84d/36f | 110c148f | 167d/48f | 84d/36f | — |
| | | Arrangement | 3-in/1-out | 2-in/2-out | 1-in/3-out | 1-in/1-out | 1-in/1-out | — |
| | | Loop number (per (25.4 mm)$^2$) | 306 | 240 | 156.25 | 120 | 204 | 0 |
| | Sum of loop numbers of L5 and L6 (per (25.4 mm)$^2$) | | 612 | 480 | 312.5 | 240 | 408 | 384 |
| | Sum of loop numbers of L4, L5 and L6 (per (25.4 mm)$^2$) | | 1,428 | 1,440 | 1,562.5 | 720 | 1,224 | 1,152 |
| Ratio of loop number of another knitting pattern to loop number of cord stitch pattern (%) | | | 75 | 50 | 25 | 50 | 50 | 50 |
| Porosity of spacer layer (%) | | | 99.4 | 97.6 | 95.3 | 95.3 | 98.5 | 98.6 |
| Course density (per 2.54 cm) | | | 34 | 40 | 50 | 24 | 34 | 32 |
| Wale density (per 2.54 cm) | | | 24 | 24 | 25 | 20 | 24 | 24 |
| Thickness (mm) | | | 1.8 | 2.4 | 3.0 | 4.0 | 2.4 | 2.4 |

| | | | Example 7 | Example 8 | Example 9 | Comparative Example 1 | Comparative Example 2 | Comparative Example 3 |
|---|---|---|---|---|---|---|---|---|
| Gauge of knitting machine | | | 28 G | 22 G | 28 G | 22 G | 22 G | 22 G |
| Back ground part | L1 | Knitting pattern | cord (3 needles) | cord (3 needles) | cord denbigh | cord (3 needles) | cord (3 needles) | (3 needles) |
| | | Yarn | 84d/36f | 84d/36f | 84d/36f | 84d/36f | 84d/36f | 110d/48f |
| | | Loop number (per (25.4 mm)$^2$) | 1,760 | 912 | 1,536 | 616 | 816 | 1,430 |
| | L2 | Knitting pattern | chain | chain | cord (2 needles) | chain | chain | denbigh |
| | | Yarn | 84d/36f | 84d/36f | 84d/36f | 84d/36f | 84d/36f | 110d/48f |
| | | Loop number (per (25.4 mm)$^2$) | 1,760 | 912 | 1,536 | 616 | 816 | 1,430 |
| | Sum of loop numbers of L1 and L2 (per (25.4 mm)$^2$) | | 3,520 | 1,824 | 3,072 | 1,232 | 1,632 | 2,860 |
| Connecting yarn | L3 | Yarn | 84d/36f | 84d/36f | 33d/12f | 33d/12f | 220d/96f | 330d/96f |
| Front ground part | L4 | Knitting pattern | cord (2 needles) | cord (2 needles) | cord (3 needles) | cord (2 needles) | cord (3 needles) | denbigh |
| | | Yarn | 167d/48f | 84c136f | 84d/36f | 84d/36f | 84d/36f | 110d/48f |
| | | Loop number (per (25.4 mm)$^2$) | 1,760 | 912 | 1,536 | 616 | 816 | 1,430 |
| | L5 | Knitting pattern or loop number/repeating unit | 2c/4c | 2c/4c | 1c/4c | 2c/4c | 1c/4c | 2c/4c |
| | | Yarn | 84d/36f | 84d/36f | 84d/36f | 84d/36f | 84d/36f | 110d/48f |
| | | Arrangement | full set | 2-in/2-out | 2-in/2-out | full set | 1-in/1-out | 1-in/1-out |
| | | Loop number (per (25.4 mm)$^2$) | 880 | 228 | 192 | 308 | 102 | 357.5 |
| | L6 | Loop number/repeating unit | — | 2c/4c | 1c/4c | 2c/4c | — | 2c/4c |
| | | Yarn | — | 84d/36f | 84d/36f | 84d/36f | — | 110d/48f |
| | | Arrangement | — | 2-in/2-out | 2-in/2-out | full set | — | 1-in/1-out |
| | | Loop number (per (25.4 mm)$^2$) | 0 | 228 | 192 | 308 | 0 | 357.5 |
| | Sum of loop numbers of L5 and L6 (per (25.4 mm)$^2$) | | 880 | 456 | 384 | 616 | 102 | 715 |
| | Sum of loop numbers of L4, L5 and L6 (per (25.4 mm)$^2$) | | 2,640 | 1,368 | 1,920 | 1,232 | 918 | 2,145 |
| Ratio of loop number of another knitting pattern to loop number of cord stitch pattern (%) | | | 50 | 50 | 25 | 100 | 12.5 | 50 |
| Porosity of spacer layer (%) | | | 96.7 | 98.3 | 98.9 | 99.5 | 96.0 | 89.4 |
| Course density (per 2.54 cm) | | | 55 | 38 | 48 | 28 | 34 | 55 |
| Wale density (per 2.54 cm) | | | 32 | 24 | 32 | 22 | 24 | 26 |
| Thickness (mm) | | | 3.0 | 2.8 | 2.0 | 1.4 | 3.0 | 5.8 |

Note:
The yarn arrangements in the guide bars L1 to L4 were all full set.

TABLE 2

| | | | | Example 1 | Example 2 | Example 3 | Example 4 | Example 5 |
|---|---|---|---|---|---|---|---|---|
| Evaluation | Circular modulus (N) | 10% | Warp | 62.8 | 21.1 | 63.4 | 93.8 | 50.5 |
| | | | Weft | 22.3 | 10.2 | 26.4 | 18.2 | 21.5 |
| | | | Bias | 16.3 | 17.0 | 9.8 | 22.3 | 22.0 |
| | | | Reverse bias | 20.8 | 18.0 | 14.0 | 17.8 | 21.2 |
| | | 20% | Warp | 233.0 | 99.9 | 228.5 | 268.1 | 213.9 |
| | | | Weft | 71.0 | 27.5 | 84.5 | 46.3 | 59.8 |
| | | | Bias | 48.5 | 48.5 | 27.6 | 61.2 | 76.3 |
| | | | Reverse bias | 75.4 | 50.5 | 39.6 | 45.8 | 67.1 |
| | | 30% | Warp | 459.4 | 290.0 | 464.4 | 514.1 | 456.6 |
| | | | Weft | 168.6 | 66.0 | 196.7 | 113.3 | 159.1 |
| | | | Bias | 145.8 | 117.9 | 88.5 | 183.8 | 250.2 |

TABLE 2-continued

| | | | | | | |
|---|---|---|---|---|---|---|
| | Reverse bias | 228.1 | 118.9 | 122.5 | 138.5 | 219.5 |
| Wrinkles | | A | B | A | B | A |
| Deformation | | A | B | A | B | A |
| Texture | | A | A | B | B | A |
| Total evaluation | | A | B | A | B | A |

| | Example 6 | Example 7 | Example 8 | Example 9 | Comparative Example 1 | Comparative Example 2 | Comparative Example 3 |
|---|---|---|---|---|---|---|---|
| Evaluation | 37.3 | 29.0 | 25.4 | 17.9 | 103.9 | 108.5 | 7.9 |
| | 18.8 | 21.2 | 20.6 | 18.6 | 18.2 | 15.8 | 7.1 |
| | 20.9 | 13.2 | 22.8 | 16.2 | 22.3 | 23.0 | 14.6 |
| | 13.9 | 11.1 | 11.1 | 18.4 | 17.8 | 15.6 | 12.0 |
| | 156.1 | 163.6 | 149.8 | 65.8 | 308.1 | 309.0 | 16.1 |
| | 56.7 | 57.6 | 59.8 | 52.0 | 46.3 | 44.2 | 15.6 |
| | 75.0 | 41.8 | 77.5 | 48.8 | 61.2 | 83.5 | 32.4 |
| | 41.0 | 38.8 | 38.2 | 54.1 | 45.8 | 44.9 | 26.1 |
| | 354.1 | 374.2 | 355.1 | 173.0 | 564.1 | 595.5 | 38.3 |
| | 136.0 | 135.3 | 134.9 | 108.8 | 113.3 | 70.4 | 35.9 |
| | 207.2 | 124.7 | 203.8 | 111.8 | 183.8 | 248.6 | 75.1 |
| | 117.0 | 111.6 | 110.2 | 117.1 | 138.5 | 148.2 | 50.4 |
| | A | B | B | A | C | B | C |
| | A | B | B | A | C | C | B |
| | A | B | A | A | B | C | B |
| | A | B | B | A | C | C | C |

It is apparent from Tables 1 and 2 showing Examples 1 to 9 and Comparative Examples 1 to 3 that sufficient results in wrinkles, deformation and touch are not obtained in each of: Comparative Example 1, in which the three-dimensional warp knitted fabric contains; front and back ground parts, which each have at least two knitting patterns; and connecting yarns that connects the front and back ground parts, in which the front ground part has a cord stitch pattern and another knitting pattern; the sum of the loop numbers of the two knitting patterns constituting the front ground part is equal to the sum of the loop numbers of the two knitting patterns constituting the back ground part; and the ratio of the loop number of the another knitting pattern with respect to the loop number of the cord stitch pattern is 100%; Comparative Example 2, in which the ratio of the loop numbers is less than 20%; and Comparative Example 3, in which a cord stitch pattern is not used.

In Examples 1 to 9, on the other hand, the front ground part contains a cord stitch pattern and another knitting pattern integrated with the cord stitch pattern, in which the sum of the loop number of the cord stitch pattern and the loop number of the another knitting pattern integrated with the cord stitch pattern is smaller than the sum of the loop numbers of the two knitting pattern constituting the back ground part; and the ratio of the loop number of the another knitting pattern integrated with the cord stitch pattern with respect to the loop number of the cord stitch pattern is from 20 to 80%; and thus satisfactory results are obtained, in which the circular moduli on stretch rates of 10%, 20% and 30% are in preferred ranges, and favorable results are obtained in wrinkles, deformation and touch, as compared to Comparative Examples 1 to 3.

What is claimed is:

1. A skin material for an interior material, formed of a three-dimensional warp knitted fabric comprising: front and back ground parts, each of which is formed with knitting yarns guided by at least two guide bars and each of which has at least two knitting patterns; and connecting yarns that connect the front and back ground parts; wherein the front ground part has a cord stitch pattern and another knitting pattern that is integrated with the cord stitch pattern, a sum of a number of loops of the cord stitch pattern and a number of loops of the another knitting pattern integrated with the cord stitch pattern on the front ground part is smaller than a sum of numbers of loops of the at least two knitting patterns forming the back ground part, and a ratio of the number of loops of the another knitting pattern integrated with the cord stitch pattern with respect to the number of loops of the cord stitch pattern is from 20 to 80%.

2. The skin material for an interior material according to claim 1, wherein the another knitting pattern integrated with the cord stitch pattern is knitted by casting off of knitting yarns.

3. The skin material for an interior material according to claim 1, wherein the another knitting pattern integrated with the cord stitch pattern is knitted by making looping of knitting yarns forming the knitting pattern be discontinuous in a warp direction by an interval of a prescribed courses.

4. The skin material for an interior material according to claim 1, wherein the another knitting pattern integrated with the cord stitch pattern is knitted by casting off of knitting yarns, and by making looping of the knitting yarns be discontinuous in a warp direction by an interval of a prescribed courses.

5. A skin material for an interior material, formed of a three-dimensional warp knitted fabric comprising: front and back ground parts, each of which is formed with knitting yarns guided by at least two guide bars and each of which has at least two knitting patterns; and connecting yarns that connect the front and back ground parts; wherein the front ground part has a cord stitch pattern and another knitting pattern that is integrated with the cord stitch pattern, a sum of a number of loops of the cord stitch pattern and a number of loops of the another knitting pattern integrated with the cord stitch pattern on the front ground part is smaller than a sum of numbers of loops of the at least two knitting patterns forming the back ground part, and a ratio of the number of loops of the another knitting pattern integrated with the cord stitch pattern with respect to the number of loops of the cord stitch pattern is from 20 to 80%; and wherein the another knitting pattern integrated with the cord stitch pattern is knitted by casting off of knitting yarns on each of the two guide bars, and by making looping of the knitting yarns alternately in a warp direction by an interval of prescribed courses.

6. The skin material for an interior material according to claim 1, wherein the back ground part has two knitting patterns that are formed with knitting yarns guided as full set by two guide bars and integrated with each other, and looping of knitting yarns forming the knitting patterns are made in all courses without an interval in a warp direction.

7. The skin material for an interior material according to claim 2, wherein the back ground part has two knitting patterns that are formed with knitting yarns guided as full set by two guide bars and integrated with each other, and looping of knitting yarns forming the knitting patterns are made in all courses without an interval in a warp direction.

8. The skin material for an interior material according to claim 3, wherein the back ground part has two knitting patterns that are formed with knitting yarns guided as full set by two guide bars and integrated with each other, and looping of knitting yarns forming the knitting patterns are made in all courses without an interval in a warp direction.

9. The skin material for an interior material according to claim 4, wherein the back ground part has two knitting patterns that are formed with knitting yarns guided as full set by two guide bars and integrated with each other, and looping of knitting yarns forming the knitting patterns are made in all courses without an interval in a warp direction.

10. The skin material for an interior material according to claim 5, wherein the back ground part has two knitting patterns that are formed with knitting yarns guided as full set by two guide bars and integrated with each other, and looping of knitting yarns forming the knitting patterns are made in all courses without an interval in a warp direction.

11. The skin material for an interior material according to claim 1, wherein a spacer layer is formed with the connecting yarns between the front and back ground parts, and the spacer layer has a porosity of from 88.0 to 99.8%.

12. The skin material for an interior material according to claim 1, wherein among the front and back ground parts, the ground part that is on a side adhered to the base material has fluff by a raising treatment.

* * * * *